US006014347A

United States Patent [19]

Mignot et al.

[11] Patent Number: 6,014,347

[45] Date of Patent: Jan. 11, 2000

[54] DEVICE CAPABLE OF BEING SUBMERGED AND INCLUDING AN ACOUSTIC TRANSDUCER

[75] Inventors: Jean-Pierre Mignot, Peseux; Paul Dinnissen, Schwadernau, both of Switzerland

[73] Assignee: Asulab S.A., Bienne, Switzerland

[21] Appl. No.: 09/129,866

[22] Filed: Aug. 6, 1998

[30] Foreign Application Priority Data

Aug. 28, 1997 [CH] Switzerland ..... 2014/97

[51] Int. Cl.[7] ..... G04B 37/00; G04C 21/00; G04C 21/16

[52] U.S. Cl. ..... 368/88; 368/250; 368/255; 368/276

[58] Field of Search ..... 368/72, 74, 88, 368/250, 255, 276, 309

[56] References Cited

U.S. PATENT DOCUMENTS 4,298,973 11/1981 Saito ..... 368/276

FOREIGN PATENT DOCUMENTS 375664 4/1964 Switzerland .

OTHER PUBLICATIONS

Patent Abstracts of Japan, vol. 4, No. 51, (p–007) Apr. 17, 1980, & JP 55 020464 A (Seiko Instr & Electronics Ltd)., Feb. 13, 1980. Abstract.

Patent Abstracts of Japan, vol. 8, No. 58, (p–261) Mar. 16, 1984 & JP 58 206998 A (Daini Seikosha KK). Dec. 2, 1983. Abstract.

*Primary Examiner*—Vit Miska

*Attorney, Agent, or Firm*—Griffin, Butler, Whisenhunt & Szipl, LLP

[57] ABSTRACT

A case (2) in which an acoustic transducer (22) is mounted so as to communicate in a watertight manner with the exterior of the case (2) via acoustic energy.

The transducer (22) is attached to a membrane (17) separating it in a watertight manner from an inlet cavity (10, 11) which is arranged in the case (2) and is in direct communication with the exterior. The membrane (17) is resiliently applied by its periphery onto a rest surface (12) arranged around the cavity separating the latter in a watertight manner from a deformation chamber (13) situated on the side of the membrane (17) opposite to the inlet cavity while being in communication with the interior of the case. The bottom (13*a*) of the deformation chamber (13) forms a support surface for said membrane (17) when external static pressure greater than a predetermined value is applied thereto.

13 Claims, 1 Drawing Sheet

DEVICE CAPABLE OF BEING SUBMERGED AND INCLUDING AN ACOUSTIC TRANSDUCER

The present invention relates to a device capable of being submerged in a liquid such as water, like for example a device worn on the wrist such as a watch. More particularly, the invention concerns a device of this type in which an acoustic transducer is mounted in the case.

In order to guarantee the water resistance of watches worn on the wrist to a depth of immersion which may nominally reach thirty odd meters, mounting an acoustic transducer in the watch case without any communication path being provided between the transducer and the exterior which is capable of directly leading the sound waves is already known from the prior art. Such an assembly has the advantage of guaranteeing very good water resistance for the watch. However, since the acoustic energy has to reach the transducer or be transmitted therefrom through the solid wall of the case, this solution is only possible if one is satisfied with mediocre acoustic quality. The band of frequencies which can be used is thus limited to the frequencies which succeed in passing through said wall. In practice, one has to work with the transducer resonance frequencies, these frequencies only being able to be transmitted effectively through a wall of the case if they correspond to a resonance frequency of such wall. This necessarily limits the range of frequencies able to be transmitted and is thus not suited to reproduction and/or reception of complex sounds such as speech or music. It will also be noted that such a wall inconveniently absorbs the transmission of sounds transmitted or received by the transducer.

An aim of the invention is to provide a device of the type indicated hereinbefore fitted with an acoustic transducer mounted so as to be able to operate over a broad acoustic spectrum, in particular the acoustic spectrum corresponding to speech, while assuring a high degree of water resistance.

The invention thus concerns a portable water resistant device capable of undergoing submersion to a predetermined depth in a liquid such as water, in particular a water resistant watch, including a case in which is mounted an acoustic transducer so as to communicate, in a watertight manner, with the exterior of the case via acoustic energy, characterised in that said acoustic transducer is attached to a membrane which is able to be deformed, separating it in a watertight manner from an inlet cavity which is arranged in said case and in direct communication with the exterior, in that said membrane is resiliently applied by its periphery onto a rest surface arranged around said cavity separating the latter in a watertight manner from a deformation chamber arranged in said case on the side of the membrane opposite said cavity while being in communication with the interior of said case, and in that the bottom of said deformation chamber forms a support surface for said membrane when an external static pressure greater than a predetermined value is applied thereto.

As a result of these features, the acoustic transducer can receive or transmit acoustic energy via the membrane which, being suspended in the case only by its peripheral edge, can vibrate freely without impeding transmission or reception of this acoustic energy to or from the transducer.

The membrane can be held applied against the case rest surface via a resilient element bearing on the bottom of the deformation chamber and acting on the edge of the membrane.

However, according to an alternative embodiment, the membrane can be held applied against its rest surface by means of its own resilience by being mounted taut in the case.

Other features and advantages of the invention will appear during the following description, given solely by way of example and made with reference to the annexed drawing, in which.

Figures 1, 2, 3:
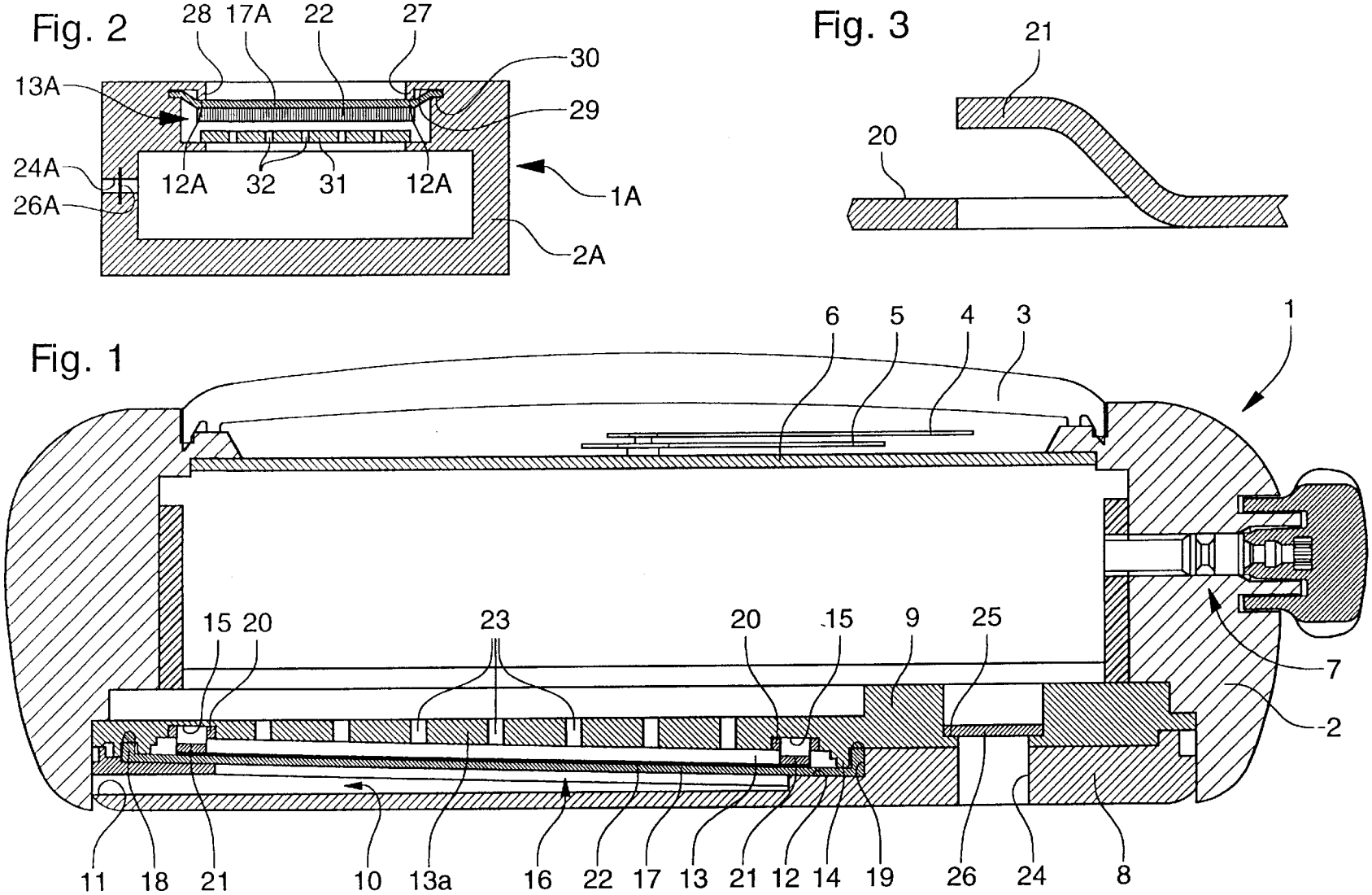
FIG. 1 shows a cross-section of a timepiece made according to the invention and fitted with a transducer which in this example is a loud-speaker.
FIG. 2 is a schematic cross-sectional view of an alternative embodiment of the invention.
FIG. 3 shows a detail of the resilient means holding the transducer unit in position against a rest surface.

In the following description, the invention will be illustrated in its application to a timepiece such as a wristwatch. It is clear however that the invention can be applied to any other device, which is in general portable and of small dimensions and has to include at least one acoustic transducer, the device being further capable of being submerged in a liquid such as water to a predetermined depth. Moreover, in the example described, the acoustic transducer is a loud-speaker, however a microphonic transducer may also be advantageously used with the invention.

This being so, FIG. 1 shows a cross-section of a wristwatch 1 whose water resistance is guaranteed to a predetermined depth of water, a depth of 30 meters being a value often given in practice.

Watch 1 in FIG. 1 includes a case 2, a crystal 3, hands 4 and 5, a dial 6 and certain parts of a time-setting mechanism 7. All these elements, as well as those sketched or not visible in FIG. 1, such as the integrated circuit, the quartz, the miniature motor, the gear train etc. are conventional and thus do not need to be described here. Although this is not a limitative application of the invention, the device according to the invention fitted with the microphonic transducer or loud-speaker could advantageously be a watch forming a portable telephone.

In the case shown, the case 2, includes a back cover 8 lined with a support disc 9 superposed onto back cover 8 in case 2 and attached thereto by any suitable means, for example by adhesion or snap fitting.

Back cover 8 includes an inlet cavity or chamber 10, of generally circular shape and placed in communication with the exterior by means of a channel 11 which opens laterally thereinto. Around cavity 10, back cover 8 has a circular rest surface 12 which, in the present example, inclines slightly with respect to the axis of cavity 10.

Opposite cavity 10 of back cover 8, support disc 9 has a recess 13 of generally circular shape which is approximately coaxial to cavity 10 while having a slightly greater diameter. This recess 13 constitutes a deformation chamber. It is edged by a peripheral rib 14 having a rounded edge contiguous with an annular groove 15 situated on the interior with respect to rib 14.

In the volume formed by cavity 10 of back cover 8 and recess 13 of support disc 9 is arranged an acoustic transducer unit 16. This assembly includes a membrane 17 formed of a circular disc to which is fixedly attached a peripheral shoulder 18 whose external surface is bonded to a peripheral lateral wall 19 arranged around rest surface 12 respectively on back cover 8 and support disc 9. Thus, membrane 17 assures the sealing of the interior of watch 1 as regards the exterior.

In the zone situated within the inner edge of rest surface 12, membrane 17 is free to deform. It is held against this rest surface by a resilient element 20 in order to allow the active part of transducer 16 to vibrate in the lowest frequency mode. This latter is formed for example of a ring housed in groove 15 of support disc 9 and provided with Z-shaped resilient lugs 21 (FIG. 3), for example ten in number for a diameter of membrane 17 of approximately 25 mm, which are cut out and bent outside the plane thereof in the direction of membrane 17. Resilient lugs 21 are compressed and thus apply the membrane against rest surface 12 while strictly delimiting the zone of the membrane able to vibrate freely. By way of indication, resilient ring 20 develops a total force of the order of 250 to 600 g. It is clear that this force depends upon the diameter of the membrane and its weight and thickness and the acoustic frequencies which one wishes to transmit or receive.

Transducer assembly 16 also includes a transducer element 22 (forming the active part of the transducer) which, in the case shown, is a piezo-electric type loud-speaker. It may also be a receiver (microphone function). In the case shown here, it includes a metal strip inserted between two piezo-electric discs (not visible in FIG. 1), the assembly being conveniently connected to a control circuit (not detailed) housed in case 2. Transducer element 22 is bonded onto membrane 17 on the side of recess 13 in the free vibration zone around the latter. It is available commercially from the Murata company, Japan. According to an alternative, transducer element 22 may also be attached to the membrane during moulding thereof, either by being partially incorporated therein, or by being duplicate moulded with the membrane material.

It is to be noted that lugs 21 preferably exert their pressure on the end edge of transducer element 22 in order for it to be able to transmit as low a frequency as possible for a given diameter. Lugs 21 abut against the edge of the metal strip of transducer element 22 via which they apply membrane 17 onto surface 12.

In order to avoid distortion, care must be taken that the application forces exerted by resilient lugs 21 are sufficient to hold transducer element 22 against the rest surface, i.e. that it is permanently held during operation. However, these forces should not block its orientation (i.e. as tough it were embedded) which would typically lead to doubling of the fundamental frequency of the transducer element.

Recess 13 forms an inner chamber which is in communication with the interior of case 2 through passage orifices 23 arranged in the base 13*a* of recess 13. Membrane 17 can thus be deformed in this inner chamber or recess 13 until it applies against base 13*a* thereof. This latter thus constitutes a stop surface for membrane 17 if the differential pressure on either side of the membrane exceeds a predetermined value.

Membrane 17 is preferably made of silicon and can have a thickness of approximately 300 $\mu$m, its diameter being 25 mm, for example.

In a zone separate from the assembly which has just been described, back cover 8 and support disc 9 include a through passage 24 having a shoulder 25 against which is arranged a pressure balancing membrane 26. This latter is water resistant but permeable to air on condition that the pressure difference variation on either side of this membrane varies very slowly. It can be made for example of sintered Teflon®. This membrane can be assimilated to a low-pass filter allowing air whose pressure varies at a very low frequency (1/10 Hz, for example) to pass. This structure allows adaptation to variations of the static pressure resulting for example from variations in altitude and/or climatic conditions, when the watch is worn.

It will be noted however that membrane 17 itself can be made in such a way that it fulfils the pressure balancing function instead of membrane 26. In this case, membrane 17 must be made of a flexible material which is semi-permeable to gases whose static pressure varies at a very low frequency.

The behaviour of membrane 17 is as follows.

When the watch is worn outside water, membrane 17 has a flat configuration in which it is free to vibrate and thus to transmit to the exterior without interference the acoustic vibrations generated by element 22.

Conversely, when the watch has just been submerged, membrane 17 will be deformed because of an abrupt variation in the differential pressure present on both of its sides. It will then assume a curved shape in the direction of bottom 13*a*, the pressure compensation path through passage 26 not managing to balance the difference in pressures rapidly enough. From a certain hydrostatic value, the deformation of membrane 17 will be such that it is applied against bottom 13*a* of recess 13, which will thus assure an efficient support preventing any deterioration of membrane 17 and transducer element 22.

FIG. 2 shows very schematically an alternative of the invention wherein a device 1A includes a case 2A fitted with a circular inlet chamber 27. This latter can be arranged in the same way as that formed by cavity 10 of FIG. 1. Around the edge of this chamber 27, turned inwards, is arranged a rib 28 of annular shape which defines a rest surface 12A. Around this rib is provided a first groove 29 into whose external wall a second groove 30 opens out.

The device also includes a membrane 17A whose outer edge is accommodated in second groove 30 to be securely fixed therein for example by bonding. Membrane 17A has inherent resilience and is fixed into groove 30 so as to be slightly taut. Consequently, it is held taut on rest surface 12A formed on annular rib 28 which exceeds by a certain distance the base of first groove 29. An acoustic converter element 22A is fixed onto membrane 17A.

Behind membrane 17A, on the inner side, there is further provided a support grid 31 forming the bottom of a deformation chamber 13A. This grid is provided with passage orifices 32 and allows membrane 17 to be held in the event of excessive pressure exerted thereon from the exterior.

A passage 24A can be provided in the wall of case 2A and be sealed by a pressure balancing membrane 26A, as in the embodiment of FIG. 1.

The arrangement of FIG. 2 differs from that of FIG. 1 in that it does not include any special resilient means for assuring application of the membrane against an element of the case, the resilience necessary for this purpose being due to the inherent resilience of the membrane itself.

What is claimed is:

1. A portable water resistant device capable of undergoing submersion to a predetermined depth in a liquid such as water, in particular a water resistant watch, including a case in which is mounted an acoustic transducer so as to communicate in a water tight manner with the exterior of the case via acoustic energy, wherein said acoustic transducer is attached to a membrane which is able to be deformed, separating it in a water-tight manner from an inlet cavity which is arranged in said case and in direct communication with the exterior, wherein said membrane is resiliently applied by its periphery onto a rest surface arranged around said cavity separating the latter in a water-tight manner from a deformation chamber arranged in said case on the side of the membrane opposite to said cavity while being in communication with the interior of said case, and wherein the bottom of said deformation chamber forms a support surface for said membrane when an external static pressure greater than a predetermined value is applied thereto.

2. A device according to claim 1, including a resilient element resting on the bottom of said deformation chamber and holding the periphery of said membrane applied against said rest surface.

3. A device according to claim 2, wherein said resilient element is a ring made of a resilient material arranged above the periphery of the membrane and including several support lugs bent outside the plane thereof and resting on said periphery.

4. A device according to claim 1, wherein said membrane is on said rest surface by virtue of its own resilience by being mounted taut in said case.

5. A device according claim 1, wherein said membrane has a peripheral rim extending beyond the plane thereof and by means of which it is bonded to the lateral wall of said deformation chamber.

6. A device according to claim 1 wherein said deformation chamber is placed in communication with the exterior by means for balancing the slow variations in the differential pressure on either side of said membrane.

7. A device according to claim 6, wherein said balancing means are formed by the membrane itself.

8. A device according to claim 6, wherein said pressure balancing means include a membrane placed in a passage arranged in the wall of said case, said passage being in communication on the one hand with the exterior and on the other hand with said deformation chamber, and wherein said membrane is made of a material which only allows a flow of air when there are slow variations in the differential pressure of its two sides.

9. A device according to claim 8, wherein said membrane is made of sintered Teflon® or ceramic material.

10. A device according to claim 1, wherein said acoustic transducer (22) is a microphone or a loudspeaker.

11. A device according to claim 1, wherein said membrane is made of silicon.

12. A device according to claim 1, wherein said membrane has a thickness of 300 $\mu$m for a diameter of 25 mm.

13. A device according to claim 1, wherein the bottom of said deformation chamber is a perforated grid.

* * * * *